United States Patent [19]

Scherz

[11] 4,366,629

[45] Jan. 4, 1983

[54] SAFETY BOOT

[76] Inventor: Hans R. Scherz, 458 Mount Stephen, Westmount, Quebec, Canada

[21] Appl. No.: 217,980

[22] Filed: Dec. 19, 1980

Related U.S. Application Data

[63] Continuation of Ser. No. 104,551, Dec. 17, 1979, abandoned.

[51] Int. Cl.[3] ..... A43B 1/10; A43B 13/42; A43C 13/14; A43B 23/00

[52] U.S. Cl. ..... 36/4; 36/7.3; 36/77 R; 36/76 R; 36/108

[58] Field of Search ..... 36/4, 7.1, 7.3, 77 R, 36/68, 83, 76, 91, 108, 113

[56] References Cited

U.S. PATENT DOCUMENTS

| | | | |
|---|---|---|---|
| 3,158,558 | 11/1964 | Bingham | 36/4 |
| 3,412,486 | 11/1968 | Ludwig | 36/4 |
| 4,016,661 | 4/1977 | Tibbitts | 36/4 |

*Primary Examiner*—Patrick D. Lawson
*Attorney, Agent, or Firm*—Swabey, Mitchell, Houle, Marcoux & Sher

[57] ABSTRACT

A safety waterproof boot of molded plastics material is provided having an integral sole and upper, the upper including a toe portion and a metatarsal portion, a metallic plate provided in the sole portion and extending the width and length thereof and allowing for longitudinal flexing of the sole, a box-shaped rigid toe guard provided in the toe portion, a rigid arched metatarsal guard member extending laterally and having side portions connected to the sole plate, the trailing edge of the toe guard being spaced inwardly relative to the leading edge of the metatarsal guard and the molded plastics material extending between the metatarsal guard and the toe guard having a flexible hinge portion in the form of a reverse fold such that the trailing edge of the toe guard will pivot inwardly of the leading edge of the metatarsal guard when the toe portion of the boot is being pivoted relative to the boot.

8 Claims, 4 Drawing Figures

SAFETY BOOT

This is a continuation, of application Ser. No. 104,551 filed Dec. 17, 1979 now abandoned.

BACKGROUND OF THE INVENTION

1. Field of the Invention

The present invention relates to boots, and more particularly, to boots used in the mining industry.

2. Description of the Prior Art

Boots used by minors are traditionally made of rubber and are heavily reinforced by hard rubber caps and ribs. An average pair of boots presently used in the mining industry weighs approximately 8 lbs.

Boots for underground mining are usually supplied in two types, that is, a first type of a relatively light rubber material having a hard rubber toe cap, and relatively form-fitting ankle and calf portions with the front of the boot partially laced from the top. The other type of boot includes a heavier rubber on canvas construction having a hard rubber toe cap and a hard rubber metatarsal guard as well as thick rubber ribs over the guard and the toe cap. The lighter boot is comfortable and of thin flexible rubber, but can be utilized only by supervisory personnel underground, engineers and surveyors, trolley and truck operators,and underground maintenance personnel. They are unsafe and impractical to wear on any mining job that requires heavy manual work. It is important that personnel doing such jobs, that is, so-called miners, wear boots which are built up to sustain heavy wear conditions, that is, working and walking on freshly broken rock, with each piece of rock presenting sharp angles. It is also important that sufficient protection be provided to protect the metatarsal portion of the foot as well as the toes. There is always a danger of tumbling rocks of varying sizes on heavy equipment landing on that portion of the boot.

However, to date, the classical miner's boot appears to be a remnant of the equipment used by armor-clad knights in the Middle Ages, giving ample protection to the foot but no flexibility of movement.

The mining boot referred to above and as somewhat illustrated in U.S. Pat. No. 1,717,127, J. Toole, 1929, includes a heavily armored toe and metatarsal guard portion made up of steel and rubber in a rigid foot portion. In other words, there is no flexibility between the toe guard and metatarsal guard portion of the boot. On the other hand, any normal footwear requires the greatest amount of flexibility at this very area because of the hinging action of the toes relative to the remainder of the foot, in a normal walking attitude.

There have been some suggested improvements in so-called rubber boots provided with toe guard and metatarsal guards. For instance U.S. Pat. No. 3,308,560, J. P. Jones 1967, describes a rubber boot having a metatarsal and instep guard integral with the outer sole of the boot and overlapping with the trailing edge of a box toe. Slight gaps are left between the laminated liner and outer to allow for shifting movement between the metatarsal guard portion and the box toe. However, although this patent recognizes the problem, it does little to solve it since the flexing of the metatarsal guard relative to the box toe would only enhance the delamination of the laminated layers between which the guard and box toe are located.

SUMMARY OF THE INVENTION

It is an aim of the present invention to provide an improved mining boot which will have sufficient armor but which will be lighter and considerably more flexible than an equivalent mining boot.

It is a further aim of the present invention to provide an improved heel construction whereby the heel portion of the boot will collapse when subjected to severe shock, thereby reducing the probability of injury to the heel of the wearer.

Another aim of the present invention is to provide a one-piece molded boot which is simpler in construction and requires fewer manual steps and thus is less costly to produce.

A construction in accordance with the present invention comprises a safety waterproof boot of molded plastics material having an integral sole and upper, the upper including a toe portion and a metatarsal portion, a metallic plate provided in the sole portion and extending the width and length thereof and allowing for longitudinal flexing of the sole, a box-shaped rigid toe guard provided in the toe portion, a rigid arched metatarsal guard member extending laterally and having side portions connected to the sole plate, the trailing edge of the toe guard spaced inwardly relative to the leading edge of the metatarsal guard and the molded plastics material extending between the metatarsal guard and the toe guard having a flexible hinge portion in the form of a reverse fold such that the trailing edge of the toe guard will pivot inwardly of the leading edge of the metatarsal guard when the toe portion of the boot is being pivoted relative to the boot.

In a more specific embodiment of the present invention, the metatarsal guard includes a pair of opposed flanges at the edges of the side members and fixed to the underside of the sole plate while the toe guard member includes inwardly extending flanges lying over the top surface of the sole plate. The heel includes a portion of the sole plate extending therewithin, and a plurality of recesses formed therein providing narrow walls of plastics material therebetween such that the walls can collapse in the case of a severe shock applied to the heel.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
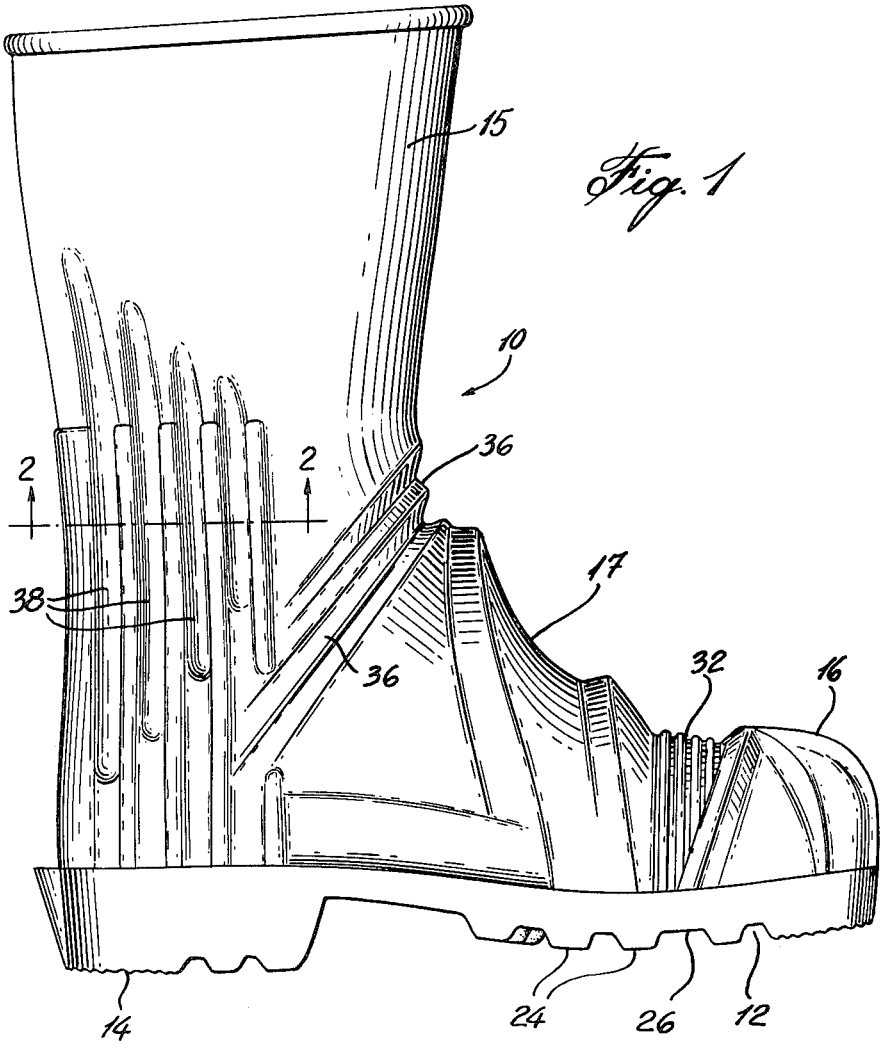
FIG. 1 is a side elevation of a mining boot in accordance with the present invention.
Figure 2:
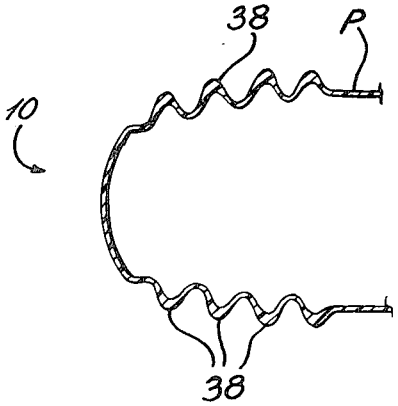
FIG. 2 is a fragmentary horizontal cross-section taken along line 2—2 of FIG. 1.

Referring now to the drawings, a mining boot 10 is shown having a sole 12, heel 14, toe portion 16, a metatarsal portion 17, and an upper calf portion 15.

Figure 3:
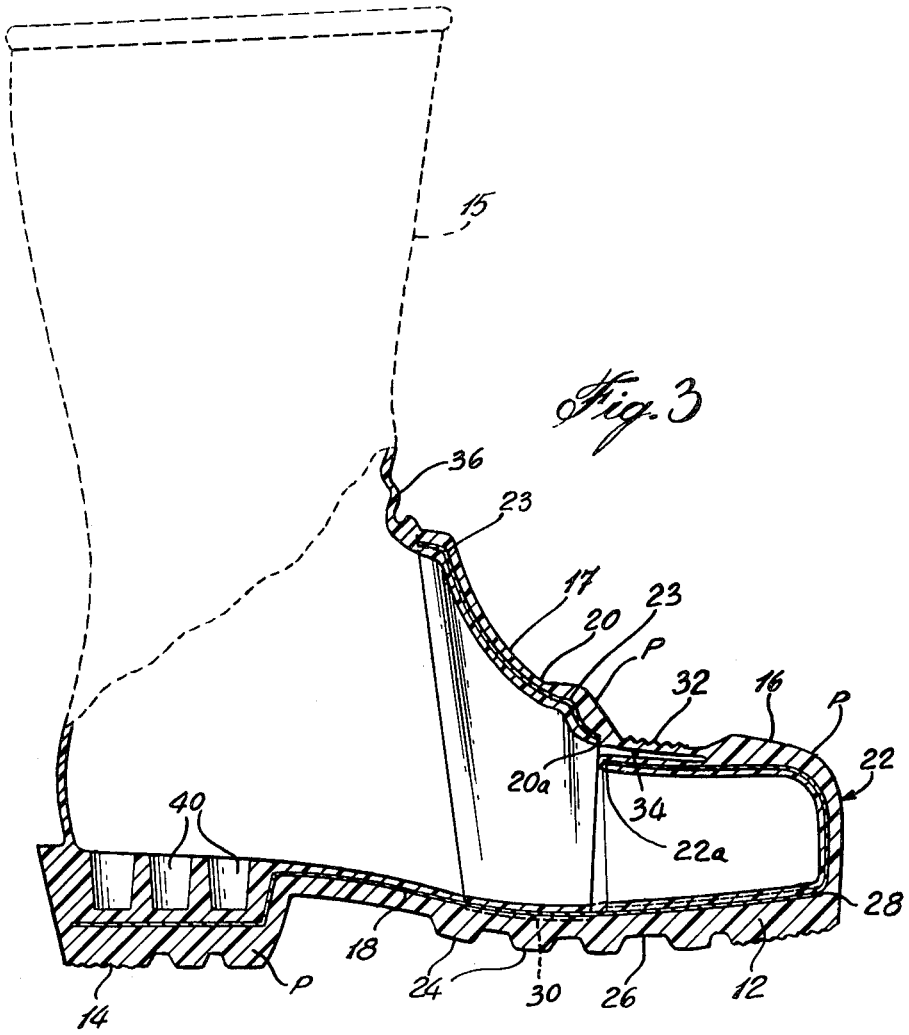
FIG. 3 is a fragmentary vertical longitudinal cross-section of the boot shown in FIG. 1.
Figure 4:
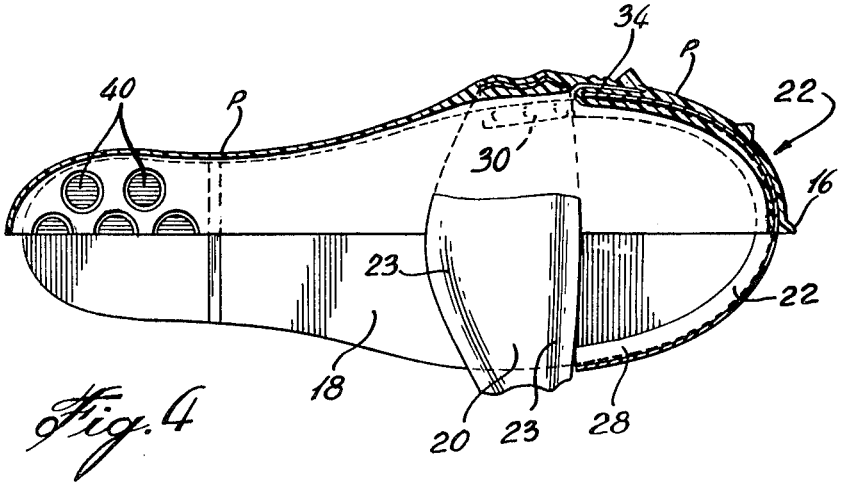
FIG. 4 is a plan view showing partly in cross-section a side wall of the boot and partly the metal guard members and sole plate of the boot.

The boot is made from plastics material P and can be injected in one piece. In the course of injection molding the boot 10, the sole 12, heel 14 and upper are integrally molded. The boot 10, as shown, includes a metallic sole plate 18 extending the length and width of the sole 12 and embedded therein. The sole plate 18 has a stepped portion extending into the heel 14, as shown in FIG. 3. A plan view of the sole plate 18 is illustrated in FIG. 4.

A separate metallic toe guard 22 is dome-shaped and includes flanges 28 extending inwardly. It is fixed such that the flanges 28 overlie the top surface of the sole plate 18. It is preferable that the toe guard not be fixed to the sole plate in order to allow easy separation in the case of an emergency.

A metatarsal guard 20, which is also of rigid metallic material such as steel, includes inwardly extending flanges 30 which are fixed to the sole plate from the undersurface thereof. In other words, flanges 30 can be welded to the underside of the sole plate 18 allowing for free flexing movement. The toe guard 22 and metatarsal guard 20 are arranged such that the trailing edge 22*a* of the toe guard 22 and the leading edge 20*a* of the metatarsal guard 20 are in the same laterally extending plane, but the trailing edge 22*a* is spaced inwardly on all sides and the top from the leading edge 20*a*. A slight space is left between the toe guard 22 and the metatarsal guard 20 in the area of the sole plate 18 so as to allow flexing of the sole plate 18 so that the toe 16 can pivot relative to the boot. The metatarsal guard 20 has formed therein a pair of ribs 23 extending parallel to the laterally extending plane so as to reinforce the guard 20.

During injection molding of the boot, a last (not shown) is inserted in the mold after the armor structure, including the sole plate 18, toe guard 22 and metatarsal guard 20, have been placed in the mold. The last may have a hydraulic extending toe portion and will include a forwardly extending flange portion to form the recess 34 about the trailing edge of the toe guard 22*a*, as will be described later. The last will also have frusto-conical projections in order to form the conical recesses 40 in the heel 14. The plastics material P is injected into the mold in the conventional manner, and after the material has cooled down, the last is removed from the inner portion of the boot after retracting the toe portion.

The so-formed boot includes, as shown in FIG. 3, a hinge flexure area 32 which is in the form of a reverse fold through the bight of the fold is connected directly to the material forming the toe portion 16. In any case, the so-formed, axially extending recess 34 allows the trailing edge 22*a* of the toe 22 to move inwardly with reasonable ease during a walking attitude when the boot is rocked on its sole as in the case of a walking shoe. The trailing edge 22*a*, which is not overlapped by the trailing edge 20*a*, will assume a poisition wherein the leading edge 22*a* will overlap the trailing edge 22*a* momentarily in the pivoting of the toe 16 relative to the boot.

The flanges 28 of the toe guard 22 and the flanges 30 of the metatarsal guard are arranged as shown in order to provide increased flexing mobility of the sole plate 18.

The sole 12 of the boot is provided with ribs 24 spaced apart forming grooves. However, in the area of flexure of the sole 12, a larger groove 26 is provided to allow for easier flexing of the boot and also to provide a convenient, rung-engaging foot hold for climbing ladders.

The heel portion 14 of the boot 10 is molded integrally with the boot, and in the present embodiment, is provided with frusto-conical apertures extending downwardly in the heel forming narrow walls between the recesses 40 such that in the case of a severe shock, the walls forming recesses 40 will collapse, thereby acting as a shock absorber for the heel. It might happen in a mining situation that a miner may accidentally fall and land on his feet or have to jump from a relatively high perch onto a rock surface. In such a case, it is beleived that the walls between the recesses 40 will give, thereby acting as a shock absorber.

The sole plate 18, of course, acts, in addition to locating the toe guard 22 and the metatarsal guard 20, as armor against sharp objects from beneath the sole.

In order to provide increased ease in the walking attitude, corrugated ribs 36 are formed in the ankle area of the boot to allow flexing of the calf portion 15 relative to the tarsal portion of the boot.

Similarly, corrugated ribs 38 will be provided extending vertically in the Achilles tendon area of the boot. This particular area of the boot is form fitting and resiliently presses against the Achilles tendon. However, when the boot is being placed on one's foot, the heel of the foot displaces and expands the portion of the boot formed by the corrugations 38, thus enabling the boot to be easily fitted.

I claim:

1. A waterproof safety boot of molded plastics material having an integral sole and upper, the upper including a toe portion and a metatarsal portion, a metallic plate provided in the sole portion and extending the width and length thereof and allowing for longitudinal flexing of the sole, a box-shaped rigid toe guard provided in the toe portion, a rigid arched metatarsal guard member extending laterally and having side portions connected to the sole plate, the trailing edge of the toe guard being spaced inwardly relative to the leading edge of the metatarsal guard and the molded plastics material extending between the metatarsal guard and the toe guard having a flexible hinge portion in the form of a reverse fold such that the trailing edge of the toe guard will pivot inwardly with the leading edge of the metatarsal guard when the toe portion of the boot is being pivoted relative to the boot.

2. A boot as defined in claim 1, wherein the metatarsal guard and the toe guard fully embedded in the plastics material and the side portions of the metatarsal guard member include inwardly extending flanges fixed to the undersurface of the sole plate and the top guard portion has inwardly extending flanges lying over the sole plate.

3. A boot as defined in claim 1, wherein the flexible hinge portion of the upper is connected to the leading edge of the metatarsal guard and to an area spaced from the trailing edge of the toe guard, thus defining an axial recess in the plastics material in the area of the trailing edge thereof, providing the reverse fold such that the toe guard will pivot inwardly away from the hinge portion of the plastics material and the plastics material will fold.

4. A boot as defined in claim 1, wherein the material forming the plastics boot is corrugated in the forward ankle portions thereof upward of the metatarsal guard allowing easier flexing of the calf portion of the boot relative to the boot portion.

5. A boot as defined in claim 4, wherein the Achilles tendon area of the boot is provided with an area formed in vertical corrugations such that the Achilles portion of the boot will expand when it is being placed on the foot to allow the heel to pass and is otherwise form-fitting on the Achilles portion of the foot.

6. A boot as defined in claim 1, wherein the guard is provided with reinforcing ribs extending laterally of the boot from side to side.

7. A safety boot of molded plastic materials having an integral sole and upper, a protective plate provided in the sole portion and extending the width and length thereof and allowing for longitudinal flexing of the sole, a rigid arched metatarsal guard member extending laterally and having side portions, the side portions including depending flanges extending inwardly thereof and attached to the sole plate such as to form an integral protective cage for the inner step of a person's foot and having the cage completely rigid in a lateral plane thereby reducing the possibility of collapsing under severe shock.

8. A safety boot as defined in claim 7, wherein the metatarsal guard member has a concave outer surface in a longitudinal direction merging at a leading edge thereof, in a convex shaped rib and at the trailing edge thereof, in a convex shaped rib, each rib extending in the lateral direction of the metatarsal guard from the sole plate thereof.

* * * * *